US007988116B2

(12) United States Patent
Kacines

(10) Patent No.: US 7,988,116 B2
(45) Date of Patent: Aug. 2, 2011

(54) HANGER FOR ITEMS

(76) Inventor: Jeffery J. Kacines, Allen, TX (US)

( * ) Notice: Subject to any disclaimer, the term of this patent is extended or adjusted under 35 U.S.C. 154(b) by 0 days.

(21) Appl. No.: 12/462,574

(22) Filed: Aug. 5, 2009

(65) Prior Publication Data

US 2011/0031369 A1 Feb. 10, 2011

(51) Int. Cl.
*A47F 5/00* (2006.01)

(52) U.S. Cl. ..... 248/309.1; 248/690; 248/693; 248/915

(58) Field of Classification Search ..... D11/126, D11/117, 160, 164; 446/73, 72, 227; 248/915, 248/914, 231.7, 304, 690, 692, 693; D21/629
See application file for complete search history.

(56) References Cited

U.S. PATENT DOCUMENTS

| | | | | | |
|---|---|---|---|---|---|
| 2,484,779 | A | * | 10/1949 | Buttner et al. | 261/60 |
| 2,536,407 | A | * | 1/1951 | Wolfe | 248/215 |
| D249,027 | S | * | 8/1978 | Dibble | D11/125 |
| 4,637,907 | A | * | 1/1987 | Hegel et al. | 264/45.7 |
| 4,809,938 | A | * | 3/1989 | Skinner et al. | 248/102 |
| 5,642,819 | A | | 7/1997 | Ronia | |
| D411,069 | S | * | 6/1999 | Bear | D6/599 |
| 6,035,449 | A | | 3/2000 | Galler et al. | |
| D447,936 | S | | 9/2001 | Kacines | |
| 6,378,827 | B1 | | 4/2002 | Kacines | |
| D550,587 | S | * | 9/2007 | Limber | D11/128 |
| 2006/0183397 | A1 | * | 8/2006 | Kanahele et al. | 446/26 |
| 2009/0149698 | A1 | * | 6/2009 | Tastard | 600/27 |

OTHER PUBLICATIONS

Enesco Cherished Teddies Bear W. Scarf Stocking Holder, Ebay Advertisement.
"Cherished Teddies by Enesco", U.S. Trademark Registration 2,516,829.
Snowman Mantel Glittery Christmas Stocking Holder, Ebay Advertisement.
Cast Iron Stocking Holder ..Snowman, Ebay Advertisement.
Hallmark Vintage Snoopy Stocking Holder, Ebay Advertisement.
Disney Tinkerbell Stocking Holder NIB, Ebay Advertisement.

* cited by examiner

*Primary Examiner* — Amy J Sterling
(74) *Attorney, Agent, or Firm* — Roger N. Chauza, P.C.

(57) ABSTRACT

An ornamental hanger constructed with a soft ornamental figure having a bottom portion weighted with a deformable weight so that if the ornamental hanger is pulled off a mantle, or the like, it will not injure a person. The top portion of the figure is filled with a light weight filler to maintain the shape of the figure. The ornamental hanger includes an adjustable strap so that items can be suspended therefrom at different distances.

20 Claims, 6 Drawing Sheets

HANGER FOR ITEMS

TECHNICAL FIELD OF THE INVENTION

The present invention relates in general to decorative object holders, and more particularly to ornament holders for placement on mantles, shelves, furniture, and the like.

BACKGROUND OF THE INVENTION

It is a common practice to hang ornaments such as Christmas stockings, and the like, on a mantle or ledge to display the same. Rather than using a nail or other hanger that is permanent, temporary ornament hangers are used so that they can be placed on the mantle, shelf or ledge to hang the items therefrom, and thereafter remove the hanger without marring or leaving a hole in the woodwork. Temporary ornament hangers are disclosed in U.S. Pat. No. 5,642,819 by Ronia; U.S. Pat. No. 6,378,827 by Kacines and D447,936 by Kacines. Other ornament hangers are available which include various types of metal, glass and resin figurines attached to respective hook-like devices.

The ornament hangers known in the prior art are constructed of a hard and durable material, and if pulled off a mantle or shelf, can mar and damage the floor or furniture. These ornament hangers are more attractive to adults and less attractive to children, because the figurines are not soft and cuddly as many stuffed toys are.

From the foregoing, it can be seen that a need exists for an ornament hanger that is stable and can support the substantial weight of an ornament, but is soft and if dislodged from a mantle, the hanger will not itself injure a child or other person. Another need exists for an ornament hanger that is ornamental, and soft to prevent injuries.

SUMMARY OF THE INVENTION

In accordance with the principles and concepts of the invention, there is disclosed an ornament hanger that is soft and plush, but has sufficient weight to support a large decorative item hung therefrom. The soft nature of the ornamental hanger prevents injuries.

In accordance with another feature of the invention, there is disclosed an ornament hanger that is itself a soft and cuddly figure, shaped and colored according to the event, season or holiday being celebrated.

In accordance with one embodiment of the invention, disclosed is an ornamental figure constructed of a plush material that is soft, and filled with many small ballast articles, such as beads which are collectively deformable, so that the ornamental figure is overall soft and deformable and is less likely to injure a person or damage furniture if the ornamental hanger falls. The ornamental hanger includes a strap with a loop suspended therefrom for hanging other ornamental items therefrom.

In accordance with one feature of the invention, disclosed is an ornamental hanger that is constructed with a non-skid bottom surface to prevent lateral movement of the hanger when a heavy item is suspended from the strap.

In accordance with yet another feature of the invention, the ornamental hanger includes a loop at the end of the strap, where the loop is adjustable in length or size to correspondingly adjust the distance between the ornamental hanger and the ornamental item suspended therefrom.

With regard to one embodiment of the invention, disclosed is an ornamental hanger that includes a soft figure having a bottom portion, a deformable ballast weight located in at least a portion of the bottom portion of the figure, and an anti-skid material on a bottom surface of the figure so that when the figure is placed on a surface, the figure is less likely to be moved laterally. The ornamental hanger further includes a pliable hanger having one end fastened to the bottom of the figure, where the pliable hanger has an opposite end adapted for suspending an item therefrom.

With regard to another embodiment of the invention, disclosed is an ornamental hanger which includes a three dimensional stuffed figure having a plush material cover. The figure has a top portion and a bottom portion, a deformable ballast weight formed of many weight articles located in at least a portion of the bottom portion of the stuffed figure. The top portion of the figure is stuffed with a light weight stuffing material. An anti-skid material is located on a bottom surface of the figure so that when the figure is placed on a surface, the figure is less likely to be moved laterally. A pliable hanger has one end fastened to the bottom of the figure, and the pliable hanger has an opposite end adapted for suspending an item therefrom. The pliable hanger is adapted to generally conform to a surface contour over which the pliable hanger is routed.

With regard to yet another embodiment of the invention, disclosed is a method of making an ornamental hanger. The method includes forming a three dimensional stuffed figure having a soft body, placing a deformable ballast weight in a bottom portion of the stuffed figure, placing a light weight stuffing material in a portion of the figure to maintain a desired shape of the figure, covering a bottom surface of the body with an anti-skid material, and fastening a strap hanger to the bottom of the body so that an item can be suspended from the strap hanger.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
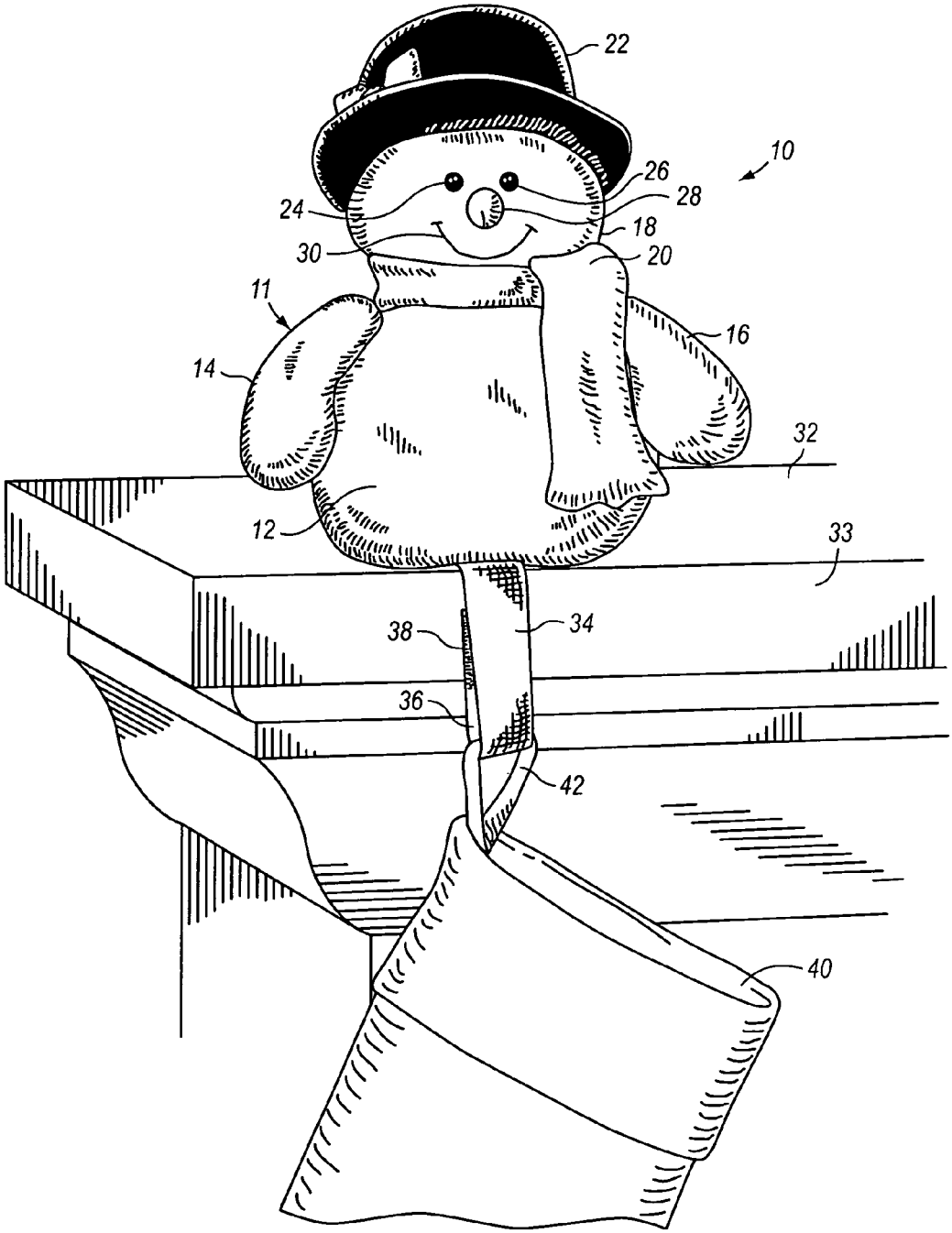
FIG. 1 is an isometric frontal view of the ornamental hanger sitting on a mantle, with a Christmas stocking suspended therefrom.

With reference to FIG. 1, there is shown an ornamental hanger 10 constructed according to one embodiment of the invention. The ornamental hanger 10 is constructed in the shape and color of a three dimensional FIG. 11, and particularly of a snowman. The snowman FIG. 11 has a large rounded body 12, two arms 14 and 16, a head 18, a scarf 20 between the head 18 and the body 12, and a hat 22. The head 18 of the snowman FIG. 11 includes a pair or eyes 24 and 26, a nose 28 and a smile 30. The colors of the materials of the snowman FIG. 11 can be selected to correspond to winter and/or Christmas holiday colors. As can be seen, the ornamental hanger 10 is an ornament itself, even of no other ornamental item is hung therefrom.

The ornamental snowman FIG. 11 is illustrated sitting on the mantle 32 of a fireplace. Of course, the ornamental hanger 10 can be placed on any other horizontal, or generally horizontal, surface having a ledge, such as a shelf, table, desk, furniture, etc. As will be described in more detail below, the ornamental snowman 10 is stuffed with a deformable ballast weight so that an item of substantial weight can be suspended therefrom. In addition, the ballast weight in the bottom of the snowman FIG. 11 makes it less likely to be tipped over if children inadvertently pull on the item hung from the ornamental hanger 10. The snowman FIG. 11 includes a strap 34 attached to the bottom thereof. The strap 34 is sufficiently long so that is hangs down over the frontal edge 33 of the mantle. The strap 34 is preferably constructed of a pliable material with a hook and loop patch attached thereto so that it can be fastened to itself and thereby form a loop 36. One of the hook or loop patch is shown as numeral 38. The Velcro® material can be used as the hook and loop patches.

A seasonal, or other type of ornamental item can be attached to the loop 36 of the strap 34. A Christmas stocking 40 is illustrated as one of many types of items that can be hung or suspended from the strap 34 of the ornamental hanger 10. The Christmas stocking 40 is of the type that has a loop 42 that can be captured in the hanger loop 36 to suspend the item 40 therefrom. The Velcro® patch 38 can be detached from the other mating patch so that the end of the strap 34 can be threaded through the stocking loop 42, and then the Velcro® patches can be reattached together to form a closed hanger loop to capture the stocking loop 42 therein. In reattaching the Velcro® patches together, the user can adjust the position by which the one Velcro patch 38 is attached to the mating Velcro® patch to achieve the desired length of the strap 34.

Figure 2:
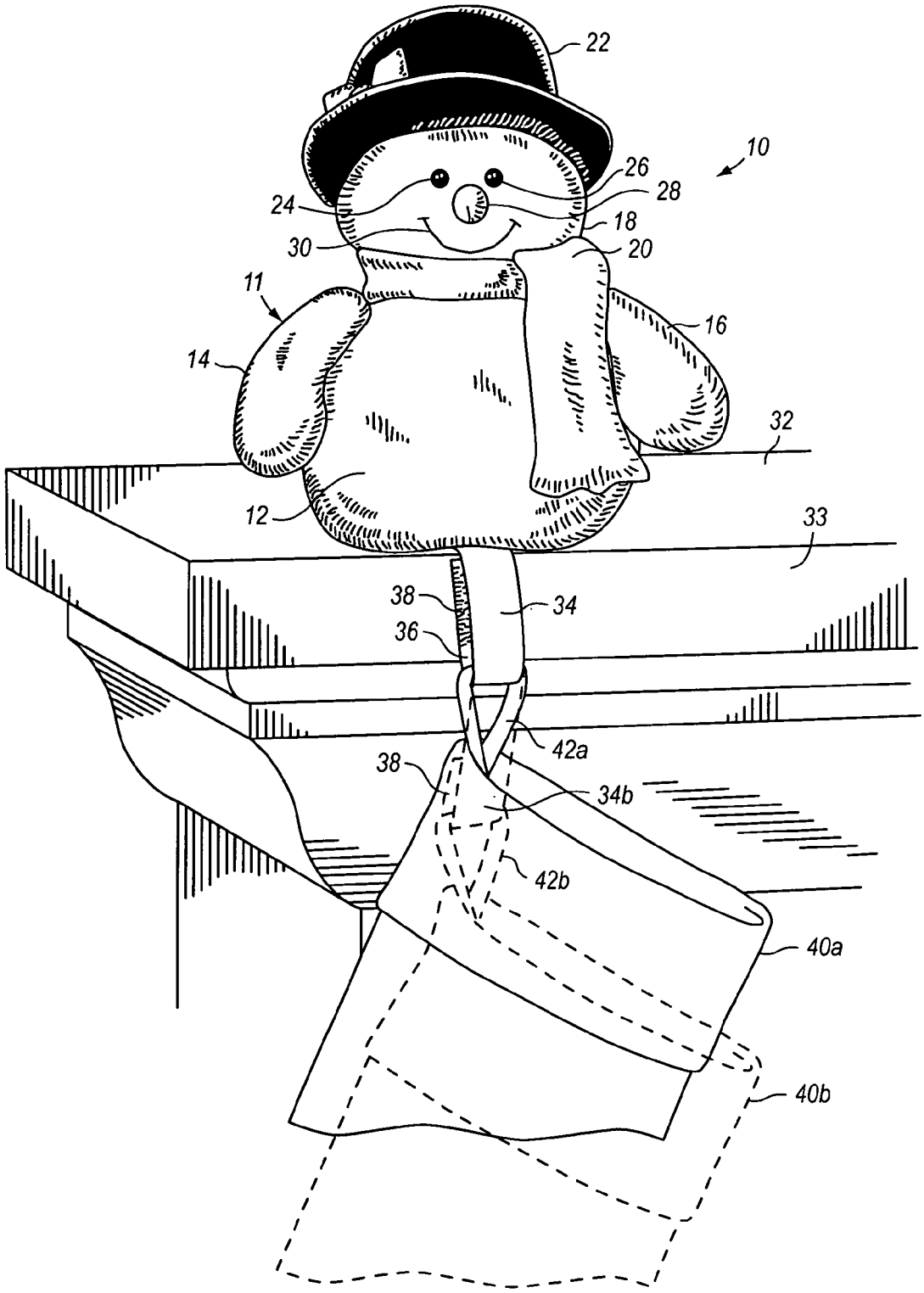
FIG. 2 is an isometric view of the ornamental hanger of FIG. 1, but showing the adjustability of the strap loop to suspend the Christmas stocking at different positions from the hanger.

FIG. 2 illustrates the different positions by which the ornamental item 40 can be suspended from the ornamental hanger 10, as a function of the adjustability of the hanger loop of the strap 34. When the Velcro® patch 38 is attached higher on the mating Velcro® patch of the strap 34, the effective length of the strap is shorter. Accordingly, when the loop 42*a* of the ornamental item 40*a* is threaded through the hanger loop, the item 40*a* is suspended higher and thus closer to the ornamental hanger 10. Conversely, when the Velcro® patch 38 is attached lower on the mating Velcro® patch of the strap 34, the effective length of the strap is longer. In this position, the loop 42*b* of the item hangs lower, as does the item 40*b* itself. The strap 34 of the ornamental hanger 10 can be of any desired length to accommodate a wide variation of effective lengths. Straps ranging in lengths from two inches to twelve inches can be employed, although many other strap lengths can be utilized. With this arrangement, Christmas stockings of different lengths or sizes can be hung at different locations with respect to the mantle 32 to provide an aesthetically pleasing display of the same.

As an alternative to the use of the Velcro® patches, those skilled in the art can employ, for example, one male snap on the end of the strap 34, and a number of spaced-apart female snaps attached to the strap so that the male snap can be engaged with a desired one of the female snaps to achieve the effective length of the strap 34 desired. A button and a number of button holes can also be used to provide adjustability to the effective length of the strap 34 and hanger loop 36. Many other techniques can be employed to achieve the adjustability described above.

While a strap 34 having an adjustable loop is preferred, those skilled in the art may utilize a fixed loop at the end of the strap 34. Moreover, the loop at the end of the strap 34 need not be part of the strap itself, but can be any other type of closed or open loop adapted to suspend items therefrom. A closed plastic ring can be fastened to the end of the strap 34 so that an open hook of the item can be engaged therewith. Conversely, an open plastic ring can be fastened to the end of the strap 34 so that a closed ring or loop of the item can be engaged therewith. Indeed, both a closed ring and an open ring can be fastened to the end of the strap 34 to accommodate the different types of hangers attached to the items.

In the preferred embodiment of the invention, the strap is constructed of a woven cotton or other synthetic material to provide strength and pliability to conform to the contour of the mantle 32 or other surface on which the ornamental hanger 10 is situated. However, the strap 34 can be constructed of many other types of materials and shapes other than a strap. For example, the strap can be constructed entirely of a plastic ribbon with the Velcro® patches adhered or otherwise bonded thereto. The strap can be constructed as a cord or strand of material having a loop at one end and the other end fastened to the bottom of the ornamental hanger 10. Many other configurations of straps or hangers can be utilized by those skilled in the art.

Figure 3:
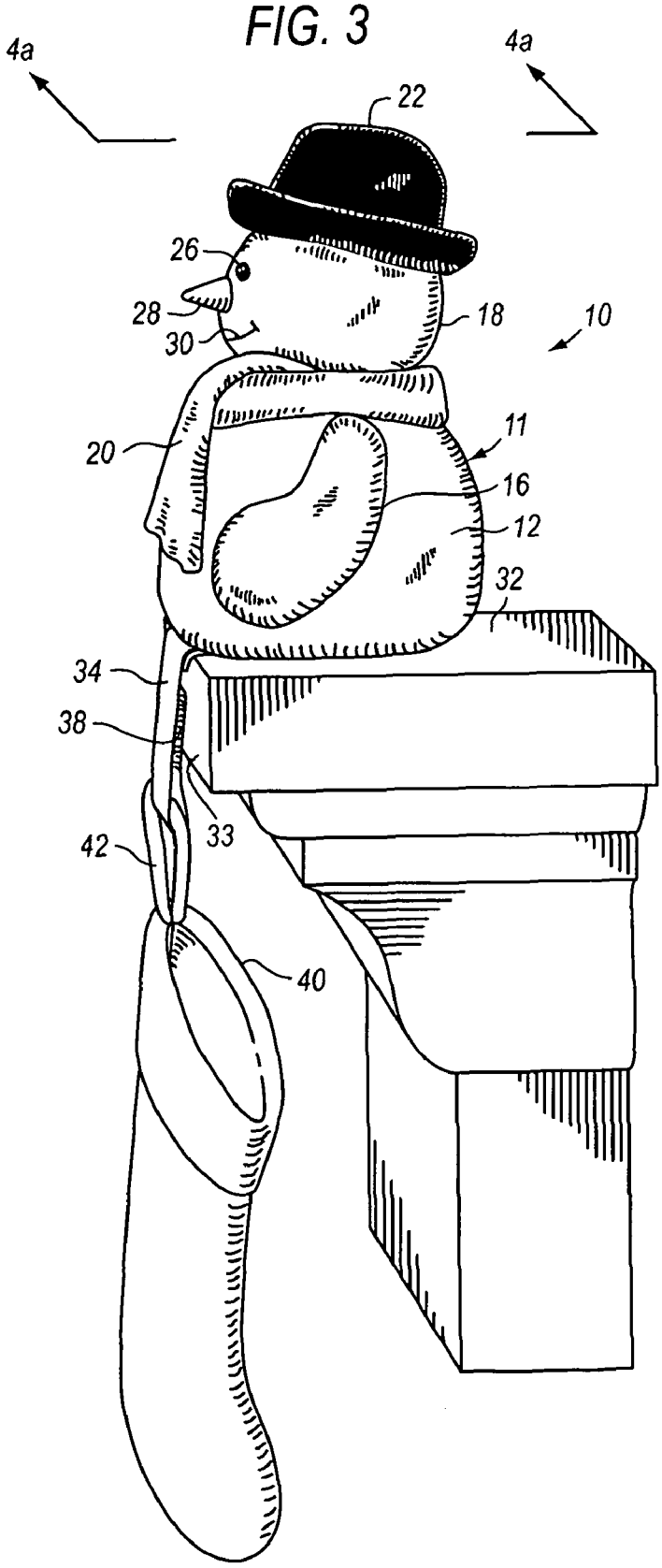
FIG. 3 is an isometric side view of the ornamental hanger.

FIG. 3 illustrates a side view of the ornamental hanger 10 situated on a mantle 32. The strap 34 is preferably constructed of a flexible woven material to conform to the contour of the edge 33 or corner of the mantle 32. The corner of the mantle 32 illustrated is generally square, and thus the strap 34 is forced to conform to such shape as it is pulled downwardly by the item 40 hanging therefrom. The strap 34 will also conform to other mantle, shelf or furniture edges which may be grooved, fluted or machined to provide a decorative edge. The ability of the strap 34 to conform to the shape of the corner or edge of the ledge on which the ornamental hanger 10 is situated, provides a more aesthetic appearance to the ornamental hanger 10.

The item, a Christmas stocking 40 in the illustration, can be quite heavy, especially when filled with candy, toys, novelty items, etc. As can be appreciated, with a heavy item hung on the ornament hanger 10, there is more force exerted on the strap 34, and thus on the ornamental FIG. 11. The downward force exerted by the item 40 on the strap 34 translates to a sideways force exerted by the same strap 34 on the ornamental hanger 10. When the strap 34 conforms to the contour of the corner or edge of the mantle 32, there is more friction between the strap and the surface of the mantle 32, and thus less tendency of the force to be sufficient to move the ornamental hanger 10. With the strap 34 fastened to the ornamental hanger 10 at the bottom thereof, there is also a reduced tendency of the ornamental hanger 10 to tip over when the item 40 is inadvertently pulled by a child or person. Rather, the tendency of the ornamental hanger 10 is to move sideways if a sufficient force is exerted on the strap 34. As will be described in more detail below, the bottom surface of the ornamental hanger 10 is constructed with an anti-skid material to resist movement with respect to the surface of the mantle 32, or other surface on which the ornamental hanger 10 rests. As a result of these features, the ornamental hanger is highly resistant to movement when a heavy load is suspended therefrom, thereby making the ornamental hanger 10 safer and less likely to be pulled over the edge of the mantle 32.

Figure 4A:
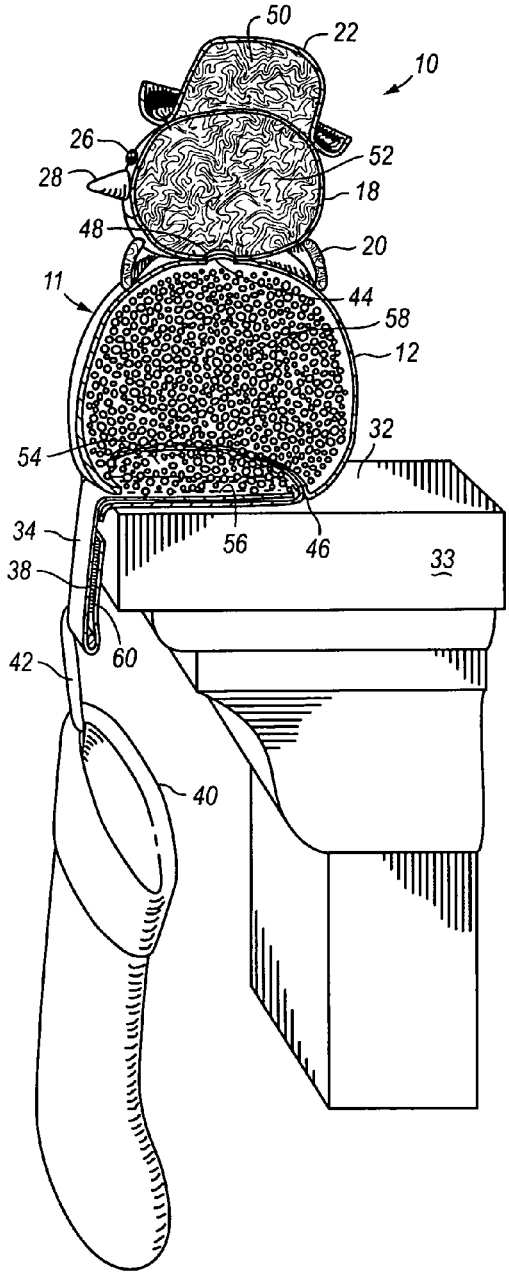
FIG. 4*a* is a partial cross-sectional view of the ornamental hanger, taken along line 4*a*-4*a* of FIG. 3, showing the material filling the ornamental hanger.
Figure 4B:
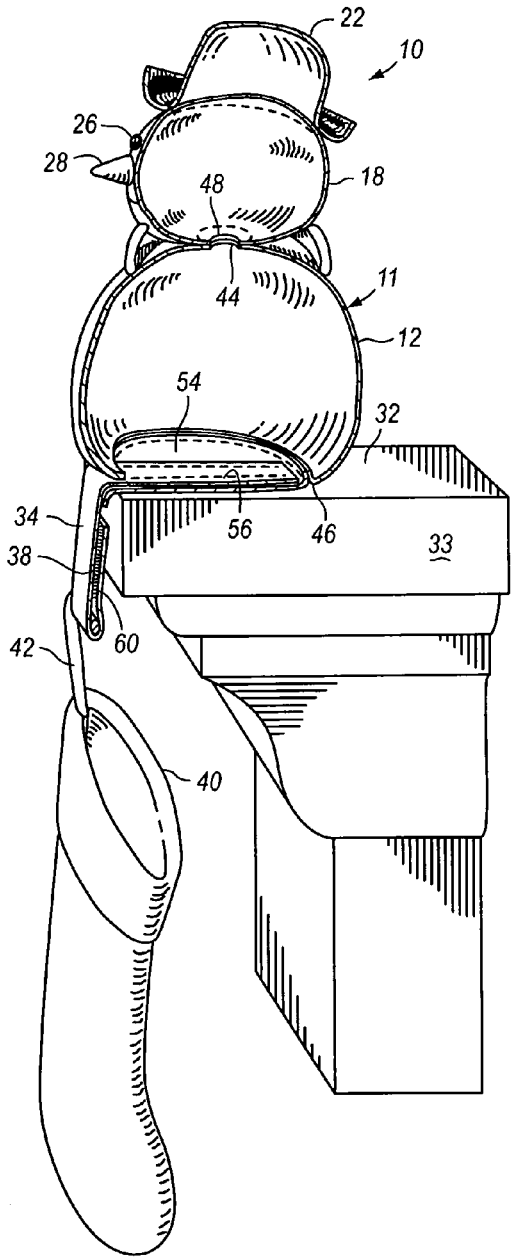
FIG. 4*b* is a view of the ornamental hanger of FIG. 4*a*, showing the ornamental hanger without the filling material.

In addition to the friction of the flexible strap 34 with respect to the mantle surfaces, the ornamental hanger 10 is weighted to resist movement when heavy items are suspended therefrom. FIG. 4*a* is a cross-sectional view of the ornamental hanger 10 filled with the different materials, and FIG. 4*b* is a cross-sectional view of the ornamental hanger 10 without the filling materials. With reference to FIG. 4*a*, the ornamental hanger 10 is a FIG. 11 having a body 12 and a head 18, both constructed of a plush material such as cotton. The colors of the different body parts can be chosen to match the seasonal type of figure employed. For example, if the figure is a snowman, then a majority of the FIG. 11 will be white, with a black hat 22. If the FIG. 11 is a penguin, then the different parts thereof would be black and white to match the color scheme of a penguin. Other colored fabrics can be used to simulate the object that is used as the ornamental figure of the hanger 10.

The fabric material of the body 12 of the figure is cut into several pieces and sewn together to form the rounded and plump body portion. The top of the body 12 includes a small opening 44, and the bottom of the body 12 has an opening 46. The head 18 is generally rounded, for a snowman, with a bottom opening 48 aligned with the top opening 44 formed in the body 12. The body 12 and the head 18 are sewn or bonded around the respective openings 44 and 48 to fasten the parts together. The hat 22 is formed in the shape shown from a cotton material, and stuffed with a lightweight stuffing material 50, such as polyester fibers, polyurethane foam, or other suitable stuffing material. The hat 22 is then sewn or bonded to the top of the head 18. The head 18 is then stuffed with the same lightweight material 52 through the aligned openings 44 and 48. The lightweight stuffing 50 and 52 function to maintain the hat 22 and the head 18 in the respective shapes shown. More importantly, the light weight stuffing 50 and 52 at the top of the figure prevents the figure from being top heavy and more prone to falling over when the bottom thereof is pulled via the strap 34. The eyes 24 and 26 can be black beads and the nose 28 can be an orange plastic cone that is glued to the head 18. The smile can be applied to the face with an ink marker, or other liquid that hardens when dried. The scarf 20 is a fabric material that is wrapped around the neck of the FIG. 11 and sewn or glued so as to fasten the scarf 20 to the FIG. 11. The arms 14 and 16 can be filled with the light weight stuffing material and sewn to the opposite sides of the body 12.

The bottom surface of the FIG. 11 includes a circular portion 54 constructed of an anti-skid type of rubberized material, such as Thermoplastic Polyurethane (TPU), a foam, or other suitable material that resists sliding on surfaces. The bottom 54 of the body 12 is pliable and thus with the weight thereon, resists movement on the surface on which it rests. Sewn onto the top surface of the bottom anti-skid material 54 is the hidden portion 56 of the strap 34. The visible portion of the strap 34 exits the bottom of the FIG. 11 in the front thereof so that the strap 34 is on the same side of the body 12 of the figure as the face.

The circular bottom 54 can then be partially sewn to the bottom of the body 12 around most of the circular opening 46. A deformable ballast weight, such as glass or metal beads 58, beans, sand, etc., can be inserted into the body 12 via the unsewn portion between the circular bottom 54 and the bottom body opening 46. The weight can also be a solid object that is surrounded with a deformable and soft cover, such as a thick layer of foam rubber to prevent injury if the ornamental hanger 10 is pulled off the surface and onto a child or person. Should the ornamental hanger 10 be pulled completely off the mantle 32, the soft and plush nature of the hanger 10 will not mar or otherwise dent wood furniture or floors. With a body 12 of about 4-5 inches in diameter and height, the deformable ballast weight filling the body 12 can weigh between about 0.5-10 pounds, and preferably about two pounds. It can be appreciated that the weight of the ballast is generally a function of the size of the figure. The stuffing 52 in the head 18 prevents the beads 58 from entering the head 18. Once filled with beads 58, the round bottom 54 is completely sewn to the bottom body opening 46. The beads 58 substantially fill the body 12 and maintain it in the shape shown. It is noted that the bottom surface of the circular anti-skid bottom 54 is somewhat pliable and conforms to the shape of the surface on which it rests. The conformance of the anti-skid bottom 54 to the underlying mantle surface increases the surface area of contact therebetween and thus increases the friction therebetween. The tendency of the ornamental hanger 10 to move laterally on the mantle surface is thus reduced.

As noted above, the end of the strap 34 that is outside of the FIG. 11 has a short length of Velcro® hook material 38 sewn or bonded to the end of the strap 34, and a long length of Velcro® loop material 60 sewn to the same side of the strap 34, but higher up on the strap 34. The effective length of the strap 34 can be changed depending on where the user places the Velcro® hook material patch 38 into engagement with the Velcro® loop material patch 60.

The figure of the ornamental hanger 10 can, or course, be other than a snowman, as shown. Indeed, for the winter, Christmas or other religious holiday season, the figure can be formed to represent a snow woman, Santa Clause, Christmas tree, Christmas present, garland, reindeer, sleigh, candy cane, candle, Advent candle, letters spelling NOEL, or a penguin. The ornamental hanger 10 can also be formed to coincide with many other holidays and events celebrated. The figure can also be that of many popular toys, play objects or caricatures well known to children or adults. For example, a princess doll or a toy truck can be fashioned with a plush material and used as the FIG. 11 of the ornamental hanger 10. Moreover, more than a single strap can be fastened to the bottom of the figure so that multiple items can be suspended therefrom.

Figure 5:
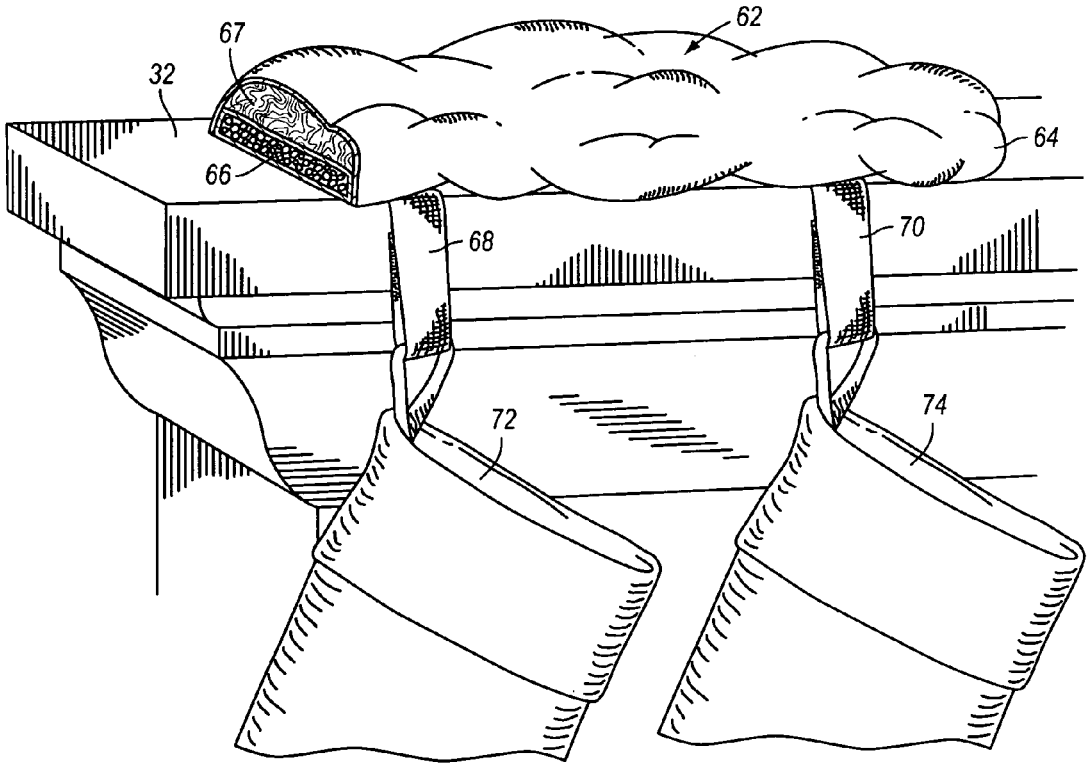
FIG. 5 is an isometric view of the ornamental hanger according to another embodiment of the invention.
Figure 6:
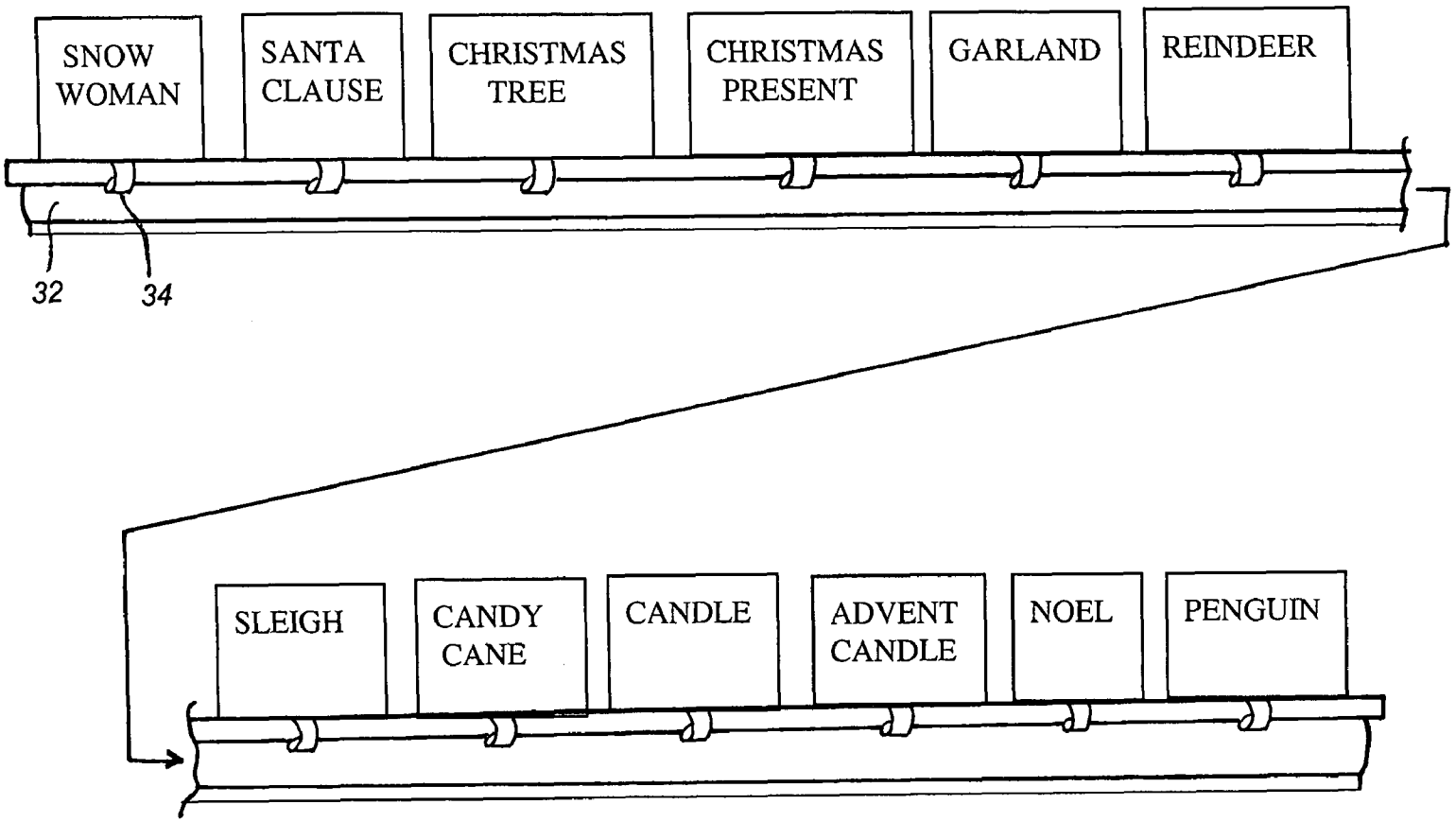
FIG. 6 illustrates in simplified form various ornamental figures according to the invention.

With reference now to FIG. 5, there is illustrated an ornamental hanger 62 in the form of a snow drift or snow bank. The snow drift 62 is formed with a fluffy white cover 64 fastened to a weight-filled base 66. A light weight filler 67 is stuffed into the space between the base 66 and the cover 64 to maintain the cover 64 in the shape of the snow drift. The cover 64 can be sewn or bonded to the peripheral edge of the base 66. The deformable weight-filled base 66 can include a rectangular-shaped volume filled with many beads, or the like. The bottom surface of the rectangular base 66 can be coated or covered with an anti-skid material, and multiple straps 68 and 70 can be fastened to the rectangular base 66. A Christmas stocking 72 can be hung from the strap 68, and another Christmas stocking 74 can be hung from the other strap 70. More than two straps can be utilized to hang a corresponding number of items therefrom.

While the preferred and other embodiments of the invention have been disclosed with reference to specific ornamental hangers, and associated methods of fabrication thereof, it is to be understood that many changes in detail may be made as a matter of design choices without departing from the spirit and scope of the invention, as defined by the appended claims.

What is claimed is:

1. An ornamental hanger for resting on a support surface and suspending an item downwardly from an edge of the support surface, said ornamental hanger comprising:

a soft figure having a bottom portion;

a deformable ballast weight located in at least a portion of the bottom portion of the figure;

an anti-skid material on a bottom surface of the figure so that when said figure is placed on the support surface, said figure is less likely to be moved laterally toward the edge of the support surface when the item is suspended from the ornamental hanger; and a pliable hanger having one end fastened to the bottom of said figure, said pliable hanger having a length to extend over the edge of the support surface, and said pliable hanger having an opposite end adapted for suspending the item therefrom.

2. The ornamental hanger of claim 1, wherein said deformable ballast weight comprises many small articles.

3. The ornamental hanger of claim 2, wherein said small articles comprise beads.

4. The ornamental hanger of claim 1, wherein said figure includes a top portion filled with a light weight filler material, whereby said figure is bottom heavy and less likely to be tipped over.

5. The ornamental hanger of claim 1, wherein said pliable hanger comprises a strap with one end thereof attached to said anti-skid material.

6. The ornamental hanger of claim 5, wherein an opposite end of said strap includes a loop of adjustable size.

7. The ornamental hanger of claim 1, wherein said figure is selected from the group consisting of a snowman, snow woman, Santa Clause, Christmas tree, Christmas present, garland, reindeer, sleigh, candy cane, candle, Advent candle, letters spelling NOEL, or a penguin.

8. The ornamental hanger of claim 1, wherein said pliable hanger comprises a ribbon of material adapted for conforming to a general shape of an edge surface over which the ribbon is routed.

9. The ornamental hanger of claim 1, wherein said anti-skid material is a layer of material that is soft and pliable to thereby grip the support surface on which the ornamental hanger rests.

10. An ornamental hanger for resting on a support surface and suspending an item downwardly from an edge of the support surface, said ornamental hanger comprising:

a three dimensional stuffed figure having a plush material cover, said figure having a top portion and a bottom portion, said stuffed figure does not extend over any edge of the support surface so as to hang downwardly therefrom;

a deformable ballast weight formed with many individual weight articles located in at least a portion of the bottom portion of the stuffed figure;

said top portion of said figure stuffed with a light weight stuffing material;

an anti-skid material on a bottom surface of the figure so that when said figure is placed on the support surface, said figure is less likely to be moved laterally toward the edge of the support surface when the item is suspended from the ornamental hanger; and a pliable hanger having one end fastened to the bottom portion of said figure, said pliable hanger having an opposite end adapted for suspending an item therefrom, and said pliable hanger adapted to generally conform to a surface contour of the edge over which the pliable hanger is routed.

11. The ornamental hanger of claim 10, wherein said figure has a shape representative of a seasonal period of time.

12. The ornamental hanger of claim 10, wherein said top portion of said figure is attached to said bottom portion by one of sewing or bonding.

13. The ornamental hanger of claim 10, wherein an overall weight of said deformable ballast is in the range between about 0.5 pounds and about 10 pounds.

14. A method of making an ornamental hanger for resting on a support surface and suspending an item downwardly from an edge of the support surface, comprising:

forming a three dimensional stuffed figure having a soft body;

placing a deformable ballast weight in a bottom portion of the stuffed figure;

placing a light weight stuffing material in a portion of the figure to maintain a desired shape of the figure;

covering a bottom surface of the body with an anti-skid material so that the stuffed figure is less likely to move laterally on the support surface; and fastening a strap hanger to the bottom portion of the body so that an item can be suspended from the strap hanger and downwardly over the edge of the support surface at a location lower than the bottom surface of the stuffed figure.

15. The method of claim 14, further including forming the stuffed figure in the shape of a holiday caricature.

16. The method of claim 14, further including forming the strap hanger so as to provide a hanger loop of different sizes.

17. The ornamental hanger of claim 1, wherein said pliable hanger has a length so that the item suspended therefrom is lower than the bottom surface of the soft figure.

18. The ornamental hanger of claim 1, wherein the soft figure does not extend over any edge of the support surface so as to hang downwardly therefrom.

19. The ornamental hanger of claim 10, wherein said pliable hanger has a length so that the item suspended therefrom is lower than the bottom surface of the soft figure.

20. The method of claim 14, further including constructing the soft figure so as not to extend over any edge of the support surface so as to hang downwardly therefrom.

* * * * *